US007874770B2

(12) United States Patent
Omori et al.

(10) Patent No.: US 7,874,770 B2
(45) Date of Patent: Jan. 25, 2011

(54) INDEXABLE INSERT

(75) Inventors: Naoya Omori, Itami (JP); Yoshio Okada, Itami (JP); Minoru Itoh, Itami (JP); Susumu Okuno, Itami (JP); Shinya Imamura, Itami (JP)

(73) Assignee: Sumitomo Electric Hardmetal Corp., Hyogo (JP)

( * ) Notice: Subject to any disclaimer, the term of this patent is extended or adjusted under 35 U.S.C. 154(b) by 819 days.

(21) Appl. No.: 11/813,115

(22) PCT Filed: Mar. 14, 2006

(86) PCT No.: PCT/JP2006/304955

§ 371 (c)(1),
(2), (4) Date: Jun. 29, 2007

(87) PCT Pub. No.: WO2006/112221

PCT Pub. Date: Oct. 26, 2006

(65) Prior Publication Data

US 2009/0311056 A1 Dec. 17, 2009

(30) Foreign Application Priority Data

Mar. 30, 2005 (JP) ..... 2005-098631

(51) Int. Cl.
*B23P 15/28* (2006.01)
*B23P 15/30* (2006.01)

(52) U.S. Cl. ..... 407/119; 407/113

(58) Field of Classification Search ..... 407/113–116, 407/119; 428/698, 688; 51/295, 307, 309
See application file for complete search history.

(56) References Cited

U.S. PATENT DOCUMENTS

| | | | | |
|---|---|---|---|---|
| 5,075,181 | A * | 12/1991 | Quinto et al. | 428/698 |
| 5,232,318 | A | 8/1993 | Santhanam et al. | |
| 2009/0232611 | A1 * | 9/2009 | Omori et al. | 407/114 |
| 2009/0269150 | A1 * | 10/2009 | Omori et al. | 407/114 |

FOREIGN PATENT DOCUMENTS

| | | | |
|---|---|---|---|
| JP | 63-65079 | A | 3/1988 |
| JP | 6-79502 | | 3/1994 |
| JP | 2004-50385 | | 2/2004 |
| WO | 97/04143 | | 2/1997 |
| WO | 02/077312 | A2 | 10/2002 |
| WO | 02/077312 | A3 | 10/2002 |

OTHER PUBLICATIONS

Extended European search report, 06715627.3—1215 / 1864731 PCT/JP2006304955, Feb. 6, 2009, pp. 1-6, European Patent Office Netherlands.
WO PCT/JP2006/304955, International Search Report, Jun. 6, 2006.

* cited by examiner

*Primary Examiner*—Will Fridie, Jr.
(74) *Attorney, Agent, or Firm*—Ditthavong Mori & Steiner, P.C.

(57) ABSTRACT

A indexable insert (1) of the present invention has a structure including at least a rake face (2) and a bearing surface (5), the indexable insert (1) including a substrate and a coating layer disposed on the substrate, wherein the coating layer includes one or more layers, and at least one layer of the one or more layers covers the entire surface of the substrate and satisfies the relationship F1<F2, wherein F1 represents the residual stress in the rake face (2) and F2 represents the residual stress in the bearing surface (5).

7 Claims, 2 Drawing Sheets

INDEXABLE INSERT

TECHNICAL FIELD

The present invention relates to indexable inserts which are detachably mounted on cutting tools and used for machining of workpieces.

BACKGROUND ART

To date, indexable inserts have been detachably mounted on cutting tools to machine various types of workpieces. Such indexable inserts, for example, have a general structure such as that shown in FIG. 1. That is, as shown in FIG. 1 which shows the general structure of such a indexable insert, a indexable insert 1 usually has an upper surface, side surfaces, and a lower surface. The lower surface is often mounted on a cutting tool in a detachable manner, and the lower surface which is mounted on a cutting tool in such a detachable manner is referred to as a bearing surface 5. Meanwhile, when the lower surface serves as the bearing surface 5, the upper surface is located on the side that comes into contact with chips during cutting of a workpiece and is referred to as a rake face 2. Each side surface is located on one of the sides that come into contact with a workpiece itself and is referred to as a flank face 3. Parts corresponding to edges where the rake face 2 and the flank faces 3 intersect with each other are referred to as cutting edges 4, which play a key role in cutting. In such a indexable insert 1, a structure is generally used in which the surface of a substrate 10 is covered with a coating layer 11 as shown in FIG. 2. With respect to the coating layer, attempts have been made in which various types of compounds were used and various stresses were imparted (Japanese Unexamined Patent Application Publication No. 06-079502 (Patent Reference 1)).

When such an indexable insert is mounted on a cutting tool, problems may arise in which failures, such as breaking and fracturing, occur in the indexable insert. In many cases, the failures may occur when the indexable insert is fastened with a screw of a cutting tool or a locator.

However, effective means for preventing failures of the indexable insert has not yet been realized. It has been considered that such problems of failures cannot be solved, for example, by changing the type of compound used for the coating layer of the indexable insert and adjusting the stress between the rake face and the flank face (Patent Reference 1).

Patent Reference 1: Japanese Unexamined Patent Application Publication No. 06-079502

DISCLOSURE OF INVENTION

Problems to be Solved by the Invention

The present invention has been achieved under the circumstances described above. It is an object of the present invention to provide a indexable insert in which the occurrence of failures (i.e., breaking and fracturing; hereinafter simply referred to as "failures") is reduced when the indexable insert is mounted on a cutting tool.

Means for Solving the Problems

The present inventor has conducted intensive research to solve the above-mentioned problems, and as a result, it has been found that it might be possible to effectively reduce the problems of the occurrence of failures when a indexable insert is mounted on a cutting tool by adjusting stresses in a rake face and a bearing surface of the indexable insert. As a result of further research based on this finding, the present invention has finally been completed.

That is, an indexable insert according to the present invention has a structure including at least a rake face and a bearing surface, the indexable insert including a substrate and a coating layer disposed on the substrate, wherein the coating layer includes one or more layers, and at least one layer of the one or more layers covers the entire surface of the substrate and satisfies the relationship $F1<F2$, wherein $F1$ represents the residual stress in the rake face and $F2$ represents the residual stress in the bearing surface.

Preferably, the relationship $F1<0$ is satisfied, and also preferably, the coating layer includes at least one layer made of a compound containing at least one element selected from the group consisting of Group IVa elements (Ti, Zr, Hf, etc.), Group Va elements (V, Nb, Ta, etc.), and Group VIa elements (Cr, Mo, W, etc.) in the periodic table, Al, and Si, and at least one element selected from the group consisting of carbon, nitrogen, oxygen, and boron.

The compound is preferably aluminum oxide. The coating layer preferably has a thickness in a range of 0.05 to 30 μm.

The coating layer may be produced by chemical vapor deposition, and also may be produced by arc ion plating or magnetron sputtering.

Preferably, the substrate is made of any one of cemented carbides, cermets, high-speed steels, ceramics, sintered cubic boron nitride compacts, sintered diamond compacts, and sintered silicon nitride compacts. The indexable insert may be an indexable insert for drilling, end milling, metal-slitting saw machining, gear-cutting tool machining, reamer machining, tap machining, crankshaft pin milling, milling, or turning, and also the indexable insert may be a positive cutting insert.

Advantages

In the indexable insert of the present invention, by employing the structure described above, it is possible to successfully reduce the occurrence of failures when the indexable insert is mounted on a cutting tool.

REFERENCE NUMERALS

Figure 1:
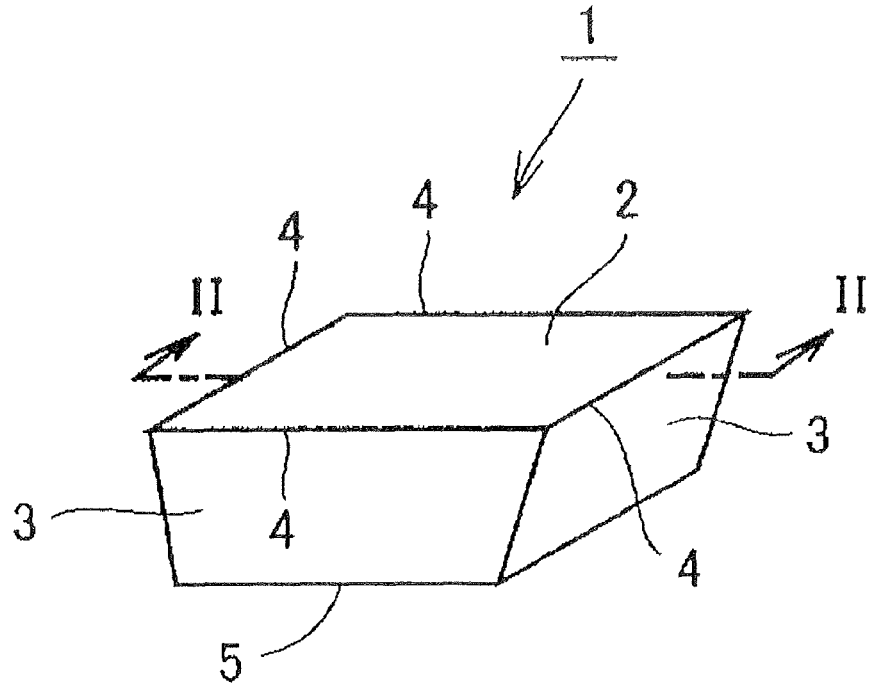
FIG. 1 is a schematic perspective view which shows a general structure of a indexable insert.

1 indexable insert
2 rake face
3 flank face
4 cutting edge
5 bearing surface
10 substrate
11 coating layer

BEST MODE FOR CARRYING OUT THE INVENTION

The present invention will be described in more detail below. Embodiments will be described with reference to the drawings. In the drawings of the present application, the same reference numerals are used to designate the same or corresponding elements. Each drawing is a schematic one for illustration purposes only. The layered structure of a coating layer, the dimensional ratio of the thickness of a coating layer to a substrate, the dimensional ratio of the corner radius (R), and the like indicated therein are different from the actual ones. Note that the expressions "rake face", "flank face", "cutting edge", "bearing surface", and the like used in the present application are concepts that include not only portions and surfaces located at uppermost surfaces of the indexable insert but also surfaces of the substrate, surfaces of the individual layers of the coating layer, and corresponding portions located inside the individual layers, etc.

<Indexable Insert>

Indexable inserts according to the present invention are detachably mounted on various cutting tools and used for machining of various workpieces. Such indexable inserts have a known general structure for this type of indexable insert. For example, as shown in FIG. 1 which shows such a general structure, a indexable insert has a structure including at least a rake face 2 and a bearing surface 5. A cutting edge 4 lies between the rake face 2 and a flank face 3, and the rake face 2 is connected to the flank 3 with the cutting edge 4 therebetween. When an upper surface serves as the rake face 2, the bearing surface 5 is located at a position corresponding to a lower surface and is a part that is mounted on a cutting tool.

Figure 2:
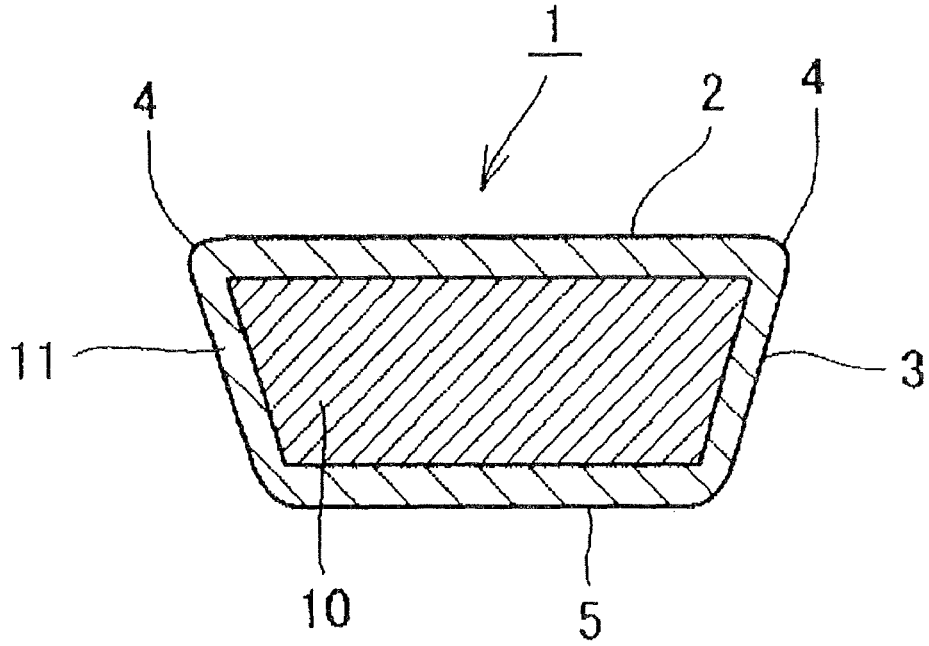
FIG. 2 is a schematic cross-sectional view taken along the line II-II of FIG. 1.

As shown in FIG. 2, which is a schematic cross-sectional view taken along the line II-II of FIG. 1, such a indexable insert includes a substrate 10 and a coating layer 11 disposed on the substrate. The coating layer 11 disposed in such a manner improves properties, such as toughness and wear resistance, and it is possible to greatly improve the durability (life) of the indexable insert. Such a coating layer will be described in detail below. FIG. 2 shows a structure in which the coating layer 11 consists of one layer only and covers the entire surface of the substrate 10. However, this is schematic only and the coating layer is not limited to such a structure.

Such a indexable insert can be used, for example, for drilling, end milling, metal-slitting saw machining, gear-cutting tool machining, reamer machining, tap machining, crankshaft pin milling, milling, or turning.

Although the shape of the indexable insert of the present invention is not particularly limited, a positive cutting insert (in which a rake face and a flank face intersect with each other at an acute angle) is preferable. The reason for this is that, in the positive cutting insert, since one of the upper and lower surfaces is used, the area of the bearing surface generally increases, and thus the effect of the present invention is easily achieved. However, examples of the indexable insert of the present invention also include a single-side negative cutting insert (in which a rake face and a flank face intersect with each other at an angle of 90° or more) and a tangential cutting insert. Furthermore, examples of the indexable insert of the present invention include those provided with chip breakers and those not provided with chip breakers. Furthermore, examples of the cutting edge include those being a sharp edge (i.e., an edge where a rake face and a flank face intersect with each other), those subjected to honing (obtained by providing a sharp edge with a corner radius), those provided with a negative land (chamfered), and combinations of those subjected to honing and those provided with a negative land.

Furthermore, in the indexable insert of the present invention, a through-hole may be formed so as to penetrate from the rake face to the bearing surface, the through-hole being used as a fixing hole for fixing the indexable insert on a tool. According to need, in addition to or in place of the fixing hole, another fixing means may be provided.

<Substrate>

As the material constituting the substrate of the indexable insert of the present invention, any of materials that are known to be used as a substrate of such a indexable insert can be used without particular limitations. Examples thereof include cemented carbides (such as WC-based cemented carbides, and those containing, in addition to WC, Co, or further incorporated with a carbide, a nitride, a carbonitride, or the like of Ti, Ta, Nb, or the like), cermets (containing TiC, TiN, TiCN, or the like as a main component), high-speed steels, ceramics (titanium carbide, silicon carbide, silicon nitride, aluminum nitride, aluminum oxide, and mixtures thereof, etc.), sintered cubic boron nitride compacts, sintered diamond compacts, and sintered silicon nitride compacts. In the case in which a cemented carbide is used for the substrate, even if the structure of the cemented carbide contains free carbon or an abnormal phase called an $\epsilon$ phase, the advantage of the present invention is exhibited.

Furthermore, the substrate made of any of these materials may be subjected to surface modification. For example, in the case of a cemented carbide, a $\beta$-free layer may be formed on the surface thereof. In the case of a cermet, a surface-hardening layer may be provided. Even if surface modification is performed as described above, the advantage of the present invention is exhibited.

<Residual Stress of Coating Layer>

The coating layer of the indexable insert according to the present invention includes one or more layers, and at least one layer of the one or more layers covers the entire surface of the substrate and satisfies the relationship $F1<F2$, wherein F1 represents the residual stress in the rake face and F2 represents the residual stress in the bearing surface. Preferably, the relationship $F1<0$ is satisfied.

The residual stress is the internal stress present in the layer and is a type of inherent distortion. The residual stress represented by a negative ("−") numerical value (units: "GPa" in the present invention) is referred to as "compressive residual stress". The residual stress represented by a positive ("+") numerical value (units: "GPa" in the present invention) is referred to as "tensile residual stress".

Figure 3:
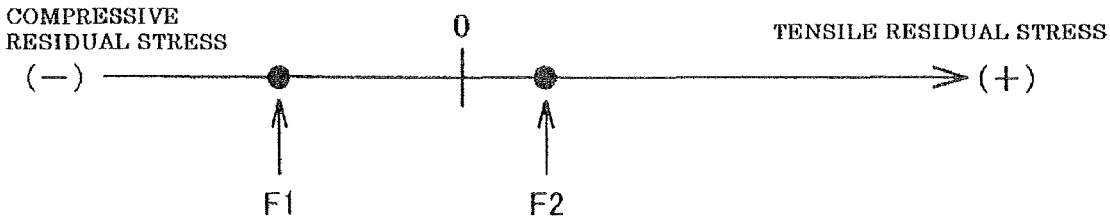
FIG. 3 is a diagram showing a concept of residual stress.
Figure 4:
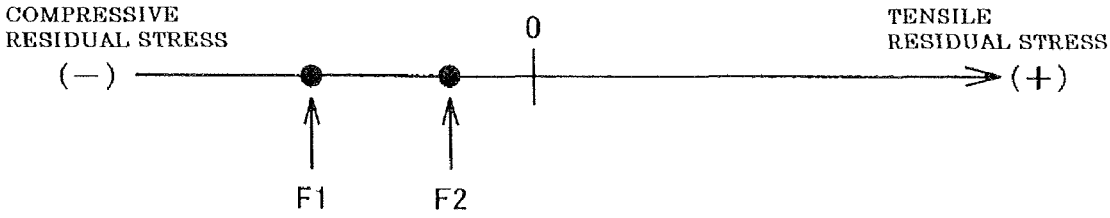
FIG. 4 is a diagram showing a concept of residual stress.

The relationship $F1<F2$ indicates that the numerical value of F1 is smaller than the numerical value F2. For example, as shown in FIGS. 3 and 4, each showing a concept of the "+" and "−" of residual stress, along a numbered axis in which compressive residual stress is placed on the left side (negative side) of the origin and tensile residual stress is placed on the right side (positive side) of the origin, the relationship in which F1 is always located to the left side of F2 is satisfied. Consequently, this is a concept different from the general case in which the magnitude correlation of residual stresses is expressed only in terms of absolute values thereof. In FIGS. 3 and 4, the origin "0" is shown. Under ordinary circumstances, 0 (GPa) indicates a state where neither compressive residual stress nor tensile residual stress is present. However, in the present invention, even in the state of 0 (GPa), residual stress is considered to be present for the sake of convenience, and each of F1 and F2 includes 0 (GPa).

As described above, with respect to at least one layer constituting the coating layer and covering the entire surface of the substrate, by setting the residual stress F1 in the rake face to be smaller than the residual stress F2 in the bearing surface (i.e., $F1<F2$), it is possible to very effectively reduce the occurrence of failures when the indexable insert is mounted on a cutting tool. Such an excellent effect is exhibited regardless of the type of the substrate to be used, which is an effect that seems to defy common sense. The reason such an excellent effect can be obtained is believed to be that a very good balance is achieved between the stress in the rake face and the stress in the bearing surface, namely, that the rake face and the bearing surface have substantially the same amount of stress. In this respect, particularly preferably, the residual stress F1 satisfies the relationship F1<0, i.e., the residual stress F1 is compressive residual stress. However, even in such a case, preferably, the residual stress F1 is adjusted so as not to be less than −8 GPa. The reason for this is that if the residual stress is less than −8 GPa, the layer itself may self-destruct in some cases.

Furthermore, the method for providing the relationship F1<F2 is not particularly limited. For example, when a coating layer is formed so as to cover the substrate by CVD, which will be described below, such a coating layer generally has tensile residual stress. Thus, after the formation, by subjecting the rake face of the coating layer to a known treatment process, such as blasting, shot-peening, barrel processing, brushing, or ion implantation, it is possible to impart compressive residual stress as F1. As a result, the relationship F1<F2 can be provided. In such a case, when the coating layer includes two or more layers, by performing the treatment process described above on the rake face at the surface of the coating layer after all the layers have been formed, it is possible to impart compressive residual stress to at least one of the layers constituting the coating layer. Alternatively, by using a method in which, after any one of two or more layers is formed, the treatment process described above is performed on the rake face of the layer, and the other layer or layers are formed thereon, it is possible to impart compressive residual stress to the layer subjected to the treatment process. Although the mode in which compressive residual stress is imparted as F1 has been mainly described, it may also be possible to impart tensile residual stress as F1 that is smaller than F2 of the bearing surface by adjusting the conditions of the treatment process. Meanwhile, by performing the treatment process on the bearing surface, along with the rake face, (provided that the treatment process is performed to a degree lower than that performed on the rake face), the residual stress F2 of the bearing surface may be compressive residual stress.

On the other hand, when the coating layer is formed by PVD, which will be described below, it is possible to provide the relationship F1<F2 to the layer by adjusting the direction of the substrate with respect to the target during the formation. Besides the adjustment method described above, for example, by performing the same treatment as that used when the coating layer is formed by CVD on the rake face, etc., it is also possible to provide the relationship F1<F2.

The residual stress can be measured by a $\sin^2 \psi$ technique using an X-ray stress measurement device. Such residual stress can be measured by a method in which stress is measured at any 10 points (which are preferably selected so as to be 0.5 mm or more apart from each other so that the stress of the region of the layer can be represented appropriately) included in the relevant region (i.e., each of the rake face and the bearing surface) in the relevant layer in the coating layer using the $\sin^2 \psi$ technique, and the average value thereof is calculated.

Such a $\sin^2 \psi$ technique using X-rays has been widely used as the method for measuring the residual stress in polycrystalline materials. For example, the method which is described in detail on pages 54 to 67 in "X-ray Stress Measurement Method" (The Society of Materials Science, Japan, 1981, published by Yokendo Ltd.) may be used.

Furthermore, the residual stress can also be measured by a method using Raman spectroscopy. Such Raman spectroscopy is advantageous because it can carry out a local measurement of a narrow range, such as a spot diameter of 1 μm. The measurement of residual stress using Raman spectroscopy is commonly carried out. For example, the method described on pages 264 to 271 in "Hakumaku no rikigakuteki tokusei hyoka gijutsu (Techniques for evaluating dynamic properties of thin films)" (Sipec (the company name has been changed to Realize Advanced Technology Limited), published in 1992) can be employed.

<Structure of Coating Layer>

As described above, the coating layer of the present invention includes one or more layers. It is characterized in that, in at least one of the one or more layers, the relationship F1<F2 is satisfied, wherein F1 represents the residual stress in the rake face and F2 represents the residual stress in the bearing surface. (Hereinafter, the layer having such characteristics may be referred to as the "characteristic layer of the present application" for the sake of convenience.)

Such a characteristic layer of the present application, which covers the entire surface of the substrate, is not necessarily disposed directly above the substrate (so as to be in direct contact with the substrate). Another layer may be disposed between the characteristic layer of the present application and the substrate. Furthermore, two or more characteristic layers of the present application may be formed. When the coating layer includes one layer only, this layer corresponds to the characteristic layer of the present application. Furthermore, although the characteristic layer of the present application may be an outermost layer of the coating layer, another layer may be disposed on the characteristic layer of the present application. Note that a layer or layers other than the characteristic layer of the present application constituting the coating layer do not necessarily cover the entire surface of the substrate and may cover only a part thereof. Furthermore, even when the characteristic layer of the present application includes portions which do not cover the substrate at parts of the substrate, such as the through-hole described above, and grooves, recesses, and the like resulting from the production conditions of the substrate, the characteristic layer is considered to cover the entire surface of the substrate in the present application.

The coating layer including the characteristic layer of the present application according to the present invention may include at least one layer made of a compound containing at least one element selected from the group consisting of Group IVa elements, Group Va elements, and Group VIa elements in the periodic table, Al, and Si, and at least one element selected from the group consisting of carbon, nitrogen, oxygen, and boron.

Preferred examples of the compound constituting the coating layer include TiC, TiN, TiCN, TiCNO, $TiB_2$, TiBN, TiBNO, TiCBN, ZrC, $ZrO_2$, HfC, HfN, TiAlN, CrAiN, CrN, VN, TiSiN, TiSiCN, AlTiCrN, TiAlCN, $Al_2O_3$, ZrCN, ZrCNO, AlN, AlCN, ZrN, and TiAlC. It is preferable to select aluminum oxide ($Al_2O_3$), in particular, among theses compounds, and to use a layer made of aluminum oxide or a layer containing aluminum oxide as a main component, as at least one layer of the coating layer. The reason for this is that it is possible to provide a coating layer having excellent wear resistance and high strength. The crystal structure of the aluminum oxide is not particularly limited. Examples thereof include $\alpha$-$Al_2O_3$, $\gamma$-$Al_2O_3$, and $\kappa$-$Al_2O_3$.

Particularly preferred examples of the compound constituting the characteristic layer of the present application among the compounds constituting the coating layer described above include, in addition to the aluminum oxide ($Al_2O_3$) described above, TiCN, TiN, TiBN, TiCNO, AlN, ZrCN, ZrN, ZrC, Zr-containing $Al_2O_3$, and $ZrO_2$. The reason for this is that in view of wear resistance, adhesion resistance, and oxidation resistance, such a layer is preferable as a coating for tools.

The coating layer preferably has a thickness in a range of 0.05 to 30 μm (total thickness when two or more layers constitute the coating layer). If the thickness is less than 0.05 μm, there may be cases in which the characteristics described above are not satisfactorily exhibited. Even if the thickness exceeds 30 μm, there is not much difference in effect, which is economically disadvantageous. With respect to the thickness of the coating layer, the upper limit is more preferably 20 μm or less, and still more preferably 15 μm or less, and the lower limit is more preferably 0.1 μm or more, and still more preferably 0.5 μm or more.

The coating layer can be formed directly on the substrate. The formation method (deposition method) of the coating layer is not particularly limited, and any known method may be employed, for example, a chemical vapor deposition (CVD) method, or a physical vapor deposition (PVD) method (including a sputtering method). In particular, when the coating layer is formed using a chemical vapor deposition method, preferably, the layer is formed by a medium-temperature CVD (MT-CVD) method. In particular, it is most suitable to provide a titanium carbonitride (TiCN) layer formed by this method, the layer having excellent wear resistance. In the conventional CVD method, film deposition is performed at about 1,020° C. to 1,030° C. In contrast, in the MT-CVD method, film deposition can be performed at a relatively low temperature of about 850° C. to 950° C. Thus, it is possible to reduce the damage of the substrate due to heating during film deposition. Consequently, the layer formed by the MT-CVD method is preferably provided in close proximity to the substrate. Furthermore, as the gas used for film deposition, use of a nitrile gas, in particular, acetonitrile ($CH_3CN$), is preferable in view of high mass productivity. By using a multilayer structure in which a layer formed by the MT-CVD method and a layer formed by a high-temperature CVD (HT-CVD) method (i.e., the conventional CVD method) are stacked on each other, adhesion between the layers in the coating layer may be improved, which is preferable in some cases.

Furthermore, when the coating layer of the present invention is formed by a physical vapor deposition method, preferably, the layer is formed by arc ion plating or magnetron sputtering. The reason for this is that excellent adhesion between the substrate and the coating layer is exhibited.

The coating layer of the present invention preferably has a structure including a base layer and a wear-indicating layer disposed on the base layer. The base layer mainly has a function of improving the various properties, such as wear resistance and toughness, of the indexable insert, and includes the characteristic layer of the present application as one layer included therein. On the other hand, the wear-indicating layer mainly has a function of identifying the use/non-use of the cutting edge. Furthermore, the wear-indicating layer preferably has a function of easily changing color when the adjacent cutting edge is used. The change in color may be caused by a change in color of the wear-indicating layer itself, or the wear-indicating layer may appear to have changed color because the wear-indicating layer is detached to expose the base layer, which is the underlying layer. Consequently, the wear-indicating layer preferably has lower wear resistance than the base layer, and also, preferably, the base layer and the wear-indicating layer have different colors and high chromatic contrast with each other.

Specific examples of the base layer are the same as those of the coating layer described above. On the other hand, specific examples of the wear-indicating layer include the followings, in addition to the same as those of the base layer.

That is, the wear-indicating layer may be at least one layer made of at least one metal (element) selected from the group consisting of Group IVa elements, Group Va elements, and Group VIa elements in the periodic table, Al, Si, Cu, Pt, Au, Ag, Pd, Fe, Co, and Ni, or an alloy containing the metal.

For example, in the case where the outermost layer of the base layer is an $Al_2O_3$ layer and has a substantially black appearance, by using a TiN layer (gold) or a Cr layer (silver) as the wear-indicating layer, it is possible to achieve a relatively high chromatic contrast.

The wear-indicating layer preferably has a smaller thickness than that of the base layer. The wear-indicating layer has a thickness (total thickness when the wear-indicating layer includes two or more layers) of preferably 0.05 to 2 μm, and more preferably 0.1 to 0.5 μm. If the thickness is less than 0.05 μm, it becomes difficult to industrially perform coating uniformly on a predetermined part, and thus, color irregularities may occur in the appearance, resulting in impairment to the appearance. Even if the thickness exceeds 2 μm, a significant difference is not observed as the wear-indicating layer, which is rather economically disadvantageous.

Preferably, the wear-indicating layer is disposed on the base layer entirely or partially in an area which lies on the rake face and which is other than an area that participates in cutting. The wear-indicating layer is also preferably disposed on the base layer entirely or partially in an area which lies on the flank face. By disposing the wear-indicating layer in such an area, it is possible to easily identify the use/non-use of the cutting edge without a demerit that the material constituting the wear-indicating layer is deposited on the workpiece and the appearance of the workpiece after cutting is impaired. Herein, the expression "an area which lies on the rake face and which is other than an area that participates in cutting" means a region on the rake face other than a region that extends from the cutting edge toward the rake face with a width of at least 0.01 mm. The width is generally 0.05 mm or more, and more generally 0.1 mm or more in many cases.

EXAMPLES

While the present invention will be described in more detail by way of examples, it is to be understood that the present invention is not limited thereto.

First, a cemented carbide powder having a composition including 87.8% by mass of WC, 1.7% by mass of TaC, and 10.5% by mass of Co was pressed. Subsequently, the resulting compact was sintered in a vacuum atmosphere at 1,400° C. for 1 hour, and then subjected to planarization polishing. A cutting edge part was subjected to cutting-edge treatment by means of SiC brush honing (providing an intersection between a rake face and a flank face with a corner radius (R) of about 0.05 mm). Thereby, a substrate of a indexable insert made of a cemented carbide having the same shape as that of a cutting insert SEMT13T3AGSN-G (manufactured by Sumitomo Electric Hardmetal Corp.) was obtained. This indexable insert had a structure including one rake face and one bearing surface.

Next, a plurality of such a substrate were prepared. Coating layers (Nos. 1 to 8) shown in Table I below were each formed on the entire surface of a corresponding substrate. In Table I below, in each coating layer, the layers were deposited over the surface of the substrate in that order from the left to the right. The coating layers Nos. 1 to 5 were each formed by a known CVD method, and the coating layers Nos. 6 to 8 were each formed by a known arc ion plating method. In Table I, those indicated as MT-CVD were formed by a MT-CVD method (film deposition temperature 900° C.), and those indicated as HT-CVD were formed by a HT-CVD method (film deposition temperature 1,000° C.).

TABLE I

| Coating layer No. | Structure of coating layer [Numerical value in parentheses shows thickness of each layer (μm).] | Total thickness (μm) |
|---|---|---|
| 1 | TiN(0.4)/MT-TiCN(2.2)/α-$Al_2O_3$(2.0)/TiN(0.5) | 5.1 |
| 2 | TiN(0.4)/MT-TiCN(2.1)/TiBN(0.4)/κ-$Al_2O_3$(1.4)/TiN(0.4) | 4.7 |
| 3 | TiC(0.4)/HT-TiCN(1.7)/$ZrO_2$(1.0)/TiN(0.3) | 3.4 |
| 4 | TiN(0.5)/MT-TiCN(2.6)/TiN(0.4) | 3.5 |
| 5 | TiN(0.5)/MT-TiCN(2.1)/TiC(1.6)/TiBN(0.4)/κ-$Al_2O_3$(1.4) | 6.0 |
| 6 | TiAlN(2.0)/α-$Al_2O_3$(2.1)/TiN(0.4) | 4.5 |
| 7 | CrAlN(3.0)/κ-$Al_2O_3$(1.4) | 4.4 |
| 8 | TiN(0.3)/TiAlN(2.6)/TiCN(0.4) | 3.3 |

Subsequently, the following treatment processes were performed to produce indexable inserts (Nos. 1 to 15) according to the present invention, in which the relationship F1<F2 was satisfied, wherein F1 represents the residual stress in the rake face and F2 represents the residual stress in the bearing surface in at least one layer of the coating layer covering the entire surface of the substrate, and indexable inserts (Nos. 16 to 19) according to comparative examples as shown in Table II below. In Table II, in the layers shown under the column "Layer", the residual stress was measured by the $\sin^2 \psi$ technique described above to obtain F1 and F2.

In the indexable inserts Nos. 1 to 8 shown in Table II below, the relationship F1<F2 was provided by performing blasting (conditions: use of alumina sand with an average grain size of 100 μm, discharge pressure 0.3 MPa, dry) on a region other than the bearing surface.

In the indexable inserts Nos. 9 to 11 shown in Table II below, the relationship F1<F2 was provided by performing blasting (conditions: use of alumina sand with an average grain size of 100 μm, discharge pressure 0.3 MPa, dry) so that the TiN layer corresponding to the outermost layer was removed from a region other than the bearing surface.

In the indexable inserts Nos. 12 and 13 shown in Table II below, the relationship F1<F2 was provided by performing blasting under different conditions from those of the indexable insert No. 1 (conditions of No. 12: use of alumina sand with an average grain size of 100 μm, discharge pressure 0.5 MPa, dry; and conditions of No. 13: use of alumina sand with an average grain size of 50 μm, discharge pressure 0.2 MPa, wet).

In the indexable inserts Nos. 14 and 15 shown in Table II below, the relationship F1<F2 was provided by performing, instead of the blasting performed in the indexable insert No. 1, a treatment process using a diamond brush (conditions of No. 14: #800 brush filament diameter 0.25 mm; and conditions of No. 15: #400 brush filament diameter 0.5 mm).

The indexable inserts Nos. 16 to 18 of the comparative examples shown in Table II were, respectively, the same as the indexable inserts Nos. 1 to 3 except that blasting was not performed, and the relationship F1<F2 was not satisfied. Furthermore, the indexable insert No. 19 of the comparative example was the same as the indexable insert No. 7 except that blasting was performed on the entire surface (under the same conditions as those in the indexable insert No. 7), and the relationship F1<F2 was not satisfied.

Using the indexable inserts Nos. 1 to 19, the following failure test was performed. That is, with respect to each of the indexable inserts Nos. 1 to 19, an operation of mounting and dismounting on and from a cutter (WGC4100R, manufactured by Sumitomo Electric Hardmetal Corp.), as a cutting tool, was repeated 2,000 times (i.e., 2,000 indexable inserts were tested for each). Then, the number of failed indexable inserts was determined. In this test, a larger number of failed cutting inserts indicates a higher probability of the occurrence of failures when the indexable insert is mounted on a cutting tool. The results thereof are shown in Table II below.

TABLE II

| | Indexable insert No. | Coating layer No. | Layer | F1 (GPa) | F2 (GPa) | Failure test (Number of failed inserts) |
|---|---|---|---|---|---|---|
| Present invention | 1 | 1 | α-$Al_2O_3$ | −1.5 | 0.2 | 3 |
| | 2 | 2 | MT-TiCN | −1.6 | 0.3 | 2 |
| | 3 | 3 | $ZrO_2$ | −1.5 | 0.2 | 2 |
| | 4 | 4 | MT-TiCN | −1.7 | 0.3 | 1 |
| | 5 | 5 | MT-TiCN | −1.6 | 0.2 | 1 |
| | 6 | 6 | α-$Al_2O_3$ | −3.4 | −2.1 | 2 |
| | 7 | 7 | κ-$Al_2O_3$ | −3.5 | −1.9 | 1 |
| | 8 | 8 | TiAlN | −3.5 | −2.0 | 2 |
| | 9 | 1 | α-$Al_2O_3$ | −5.3 | −0.3 | 1 |
| | 10 | 2 | MT-TiCN | −2.8 | −0.2 | 2 |
| | 11 | 3 | $ZrO_2$ | −3.3 | −0.3 | 1 |
| | 12 | 1 | α-$Al_2O_3$ | −4.4 | 0.2 | 2 |
| | 13 | 1 | α-$Al_2O_3$ | −2.1 | 0.0 | 1 |
| | 14 | 1 | α-$Al_2O_3$ | −0.1 | 0.2 | 1 |
| | 15 | 1 | α-$Al_2O_3$ | −0.2 | 0.3 | 1 |
| Comparative example | 16 | 1 | α-$Al_2O_3$ | 0.2 | 0.2 | 12 |
| | 17 | 2 | MT-TiCN | 0.3 | 0.3 | 14 |
| | 18 | 3 | $ZrO_2$ | 0.2 | 0.2 | 10 |
| | 19 | 7 | κ-$Al_2O_3$ | −3.2 | −3.4 | 9 |

As is evident from Table II, in the indexable inserts of the present invention in which the relationship F1<F2 is satisfied, the probability of failures occurring when the cutting insert are mounted on the cutting tool is decreased compared with the indexable inserts of the comparative examples. The results confirm that if a indexable insert has a structure in which at least one layer constituting a coating layer covers the entire surface of a substrate and the relationship F1<F2 is satisfied, wherein F1 represents the residual stress in a rake face and F2 represents the residual stress in a bearing surface, the occurrence of failures can be effectively reduced when the indexable insert is mounted on a cutting tool.

The failure test performed as described above was also performed under the following conditions (with the same composition of the substrate, the same compositions of the coating layers, and the same treatment processes for F1 and F2), and the same results were confirmed. That is, under the conditions in which the shape of the indexable insert and the model of the cutting tool (cutter) were respectively changed to the shape of an indexable insert (SDKN42MT (manufactured by Sumitomo Electric Hardmetal Corp.)) and a cutter (model FPG4100R (manufactured by Sumitomo Electric Hardmetal Corp.)), and under the conditions in which the shape of the indexable insert and the model of the cutting tool (cutter) were respectively changed to the shape of an indexable insert (CNMM190612N-MP (manufactured by Sumitomo Electric Hardmetal Corp.)) and a tool (Model PCBNR4040-64 (manufactured by Sumitomo Electric Hardmetal Corp.)), the same results were obtained (i.e., the number of failed indexable inserts of the comparative examples was two to five times larger than that of indexable inserts of the present invention.

Furthermore, three indexable inserts, which were the same as the indexable insert No. 1 of the present invention, were produced, in which the outermost layer (i.e., the TiN layer) of the coating layer was used as a wear-indicating layer, and blasting was performed by masking the necessary portions of the indexable inserts so as to form the wear-indicating layer (1) only on the rake face, (2) only on the flank face, or (3) in a region other than the vicinity of the cutting edge. The failure test performed as described above was also performed on the three indexable inserts (in each of which F1 and F2 were substantially the same as those of the indexable insert No. 1). As a result, the same excellent effect was exhibited as in the case described above, and also it was possible to easily identify the use/non-use of the cutting edge.

Although a cutter was used as the cutting tool and a positive cutting insert was used as the indexable insert in the examples described above, it is also possible to achieve the effect of the present invention in a negative cutting insert or a positive cutting insert for turning.

The embodiments and examples of the present invention described above may be combined appropriately, which is also assumed in the present invention.

The embodiments and examples which have been disclosed herein are illustrative only and not to be construed as limiting the scope of the present invention. The invention is not limited by the illustrative embodiments, but only by the scope of the appended claims, and it should be understood that various modifications may be made within the scope of the appended claims or the equivalents thereof.

The invention claimed is:

1. An indexable insert having a structure including at least a rake face and a bearing surface, comprising a substrate and a coating layer disposed on the substrate, wherein the coating layer includes one or more layers;

at least one layer of the one or more layers covers the entire surface of the substrate and satisfies the relationship $F1<F2<0$, wherein F1 represents the residual stress in the rake face and F2 represents the residual stress in the bearing surface; and the entire coating layer is produced by chemical vapor deposition.

2. The indexable insert according to claim 1, wherein the coating layer includes at least one layer made of a compound containing at least one element selected from the group consisting of Group IVa elements, Group Va elements, and Group VIa elements in the periodic table, Al, and Si, and at least one element selected from the group consisting of carbon, nitrogen, oxygen, and boron.

3. The indexable insert according to claim 2, wherein the compound is aluminum oxide.

4. The indexable insert according to claim 1, wherein the coating layer has a thickness in a range of 0.05 to 30 μm.

5. The indexable insert according to claim 1, wherein the substrate is made of any one of cemented carbides, cermets, high-speed steels, ceramics, sintered cubic boron nitride compacts, sintered diamond compacts, and sintered silicon nitride compacts.

6. The indexable insert according to claim 1, wherein the indexable insert is a indexable insert for drilling, end milling, metal-slitting saw machining, gear-cutting tool machining, reamer machining, tap machining, crankshaft pin milling, milling, or turning.

7. The indexable insert according to claim 1, wherein the indexable insert is a positive cutting insert.

* * * * *